United States Patent [19]

Loth

[11] Patent Number: 4,674,892

[45] Date of Patent: Jun. 23, 1987

[54] WRIST WATCH HAVING CERTAIN PARTS COVERED WITH EXTRA HARD MATERIAL

[75] Inventor: Eric Loth, Bienne, Switzerland

[73] Assignee: Montres Rado S.A., Lengnau, Switzerland

[21] Appl. No.: 852,262

[22] Filed: Apr. 15, 1986

[30] Foreign Application Priority Data

Apr. 16, 1985 [CH] Switzerland ..... 1616/85

[51] Int. Cl.[4] ..... G04B 37/00

[52] U.S. Cl. ..... 368/280; 368/286; 368/294; 368/295; 368/282

[58] Field of Search ..... 368/286, 295, 294, 280, 368/285, 281, 282

[56] References Cited

U.S. PATENT DOCUMENTS

| | | | |
|---|---|---|---|
| 3,242,664 | 3/1966 | Lederrey | 368/285 |
| 3,931,704 | 1/1976 | Tominaga et al. | 368/280 |
| 4,544,284 | 10/1985 | Geiger et al. | 368/294 |

*Primary Examiner*—Bernard Roskoski

*Attorney, Agent, or Firm*—Griffin, Branigan & Butler

[57] ABSTRACT

The watch case of this inveniton includes means for fixing the crystal to the case having surfaces exposed at the exterior of the watch thus susceptible to being scratched. Such visible surfaces are protected by an armour formed essentially of a substrate made from a metallic carbide and a material covering the substrate such material having a hardness greater than 5000 $HV_{0.25}$.

9 Claims, 4 Drawing Figures

WRIST WATCH HAVING CERTAIN PARTS COVERED WITH EXTRA HARD MATERIAL

This invention concerns a wrist watch including a case enclosing a movement, a crystal, means for fixing the crystal onto the case exposed at the exterior of the watch and a bracelet, certain of the parts forming the wrist watch being covered with a highly scratch resistant material.

BACKGROUND OF THE INVENTION

In Swiss Pat. No. 517.963 (U.S. Pat. No. 3,242,664) there has already been disclosed a watch case of which the visible portions of the exterior surface exposed to contact with foreign bodies, e.g. the upper surfaces of the case in the case of a wrist watch, have an unchangeable aspect, i.e. may not be scratched by contact with such bodies, nor be oxydized or tarnish in contact with air, in a manner such that it possible to give such parts of the case a fine and well finished appearance. To arrive at this result, the cited patent proposes the employment of a layer or a solid body of sintered hard metal based on a metallic carbide, e.g. tungsten carbide or titanium carbide. The teaching provided by the cited patent has been applied since then by the present assignee to a large quantity of time pieces. These results therefrom a product highly resistant to contact with foreign bodies, this not being the case for watch cases normally manufactured of steel and which oxydize and scratch readily.

As far as the bracket of the wrist watch is concerned, Swiss patent document 632.886 proposes a series of links each covered by a rectangular platelet of hard metal and this with the purpose of forming an armour strongly resistant to attack by external agents.

The spite of the considerable impovements brought by the teachings of the two cited patents, it appears that the metallic armour formed of a metallic carbide and of which the Vickers hardness (HV) is on the order of 1400, exhibits poor resistance to certain very hard agents, e.g. silica contained in dust or in sand. To be insensitive thereto, it would appear necessary that the watch case be manufactured of a material the hardness of which at least approaches that of diamond as for example disclosed in U.S. Pat. No. 3,931,704.

As disclosed in U.S. Pat. No. 3,931,704 a watch case comprises a bottom cover and a caseband integrally formed therewith. This monoblock is made of particles of sintered diamond. However, sintering of diamonds for the volume of material considered here presents major difficulties of realization in view of the high sintering temperature and pressure required in order to obtain the desired case.

SUMMARY OF THE INVENTION

In the wrist watch of the present invention is appears evident that the means for fastening the crystal to the case and the bracket suffer the greatest exposure to exterior stresses acting on the watch. It is thus above all at these places that protection must be applied. This protection consists in accordance with the invention in realizing the fixation means and/or the bracket partially or totally from a metallic carbide which serves as a substrate to a covering material said material having a hardness greater than 5000 $HV_{0.25}$.

DESCRIPTION OF THE PREFERRED EMBODIMENT

Figure 1:
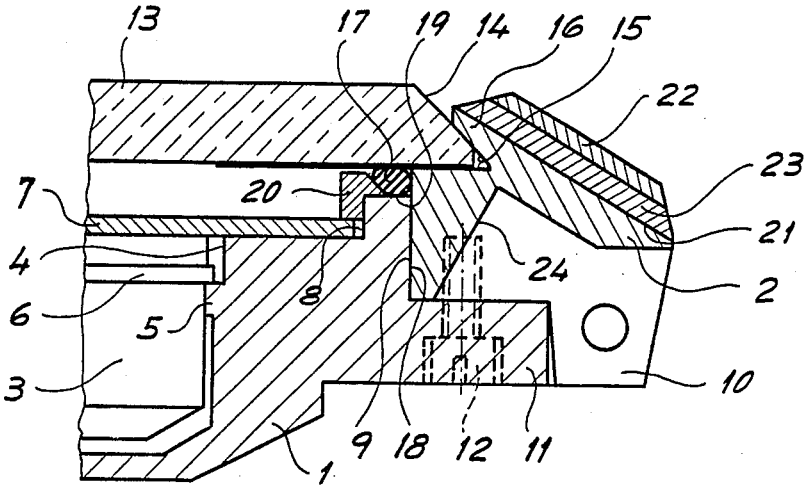
FIG. 1 is a cross section of a part of a watch case obtained in accordance with a first form of the invention.

The watch case such as it appears on FIG. 1 includes a bottom cover-caseband 1 and a caseband-bezel 2 both realized of steel. The movement 3 of the watch is encased from above in a lodging 4 of circular form in the bottom cover-caseband 1. It is held in place in this housing by a projection 5 of the bottom cover-caseband 1 on which rests the bead 6 of the movement base plate 3. Dial 7 extends beyond movment 3 into a second lodging 8 of the bottom cover-caseband 1 likewise of circular form. The caseband-bezel 2 is mounted around a cylindrical rim 9 of the bottom cover-caseband 1 and bears the fastening lugs 10 for the bracelet. It rests on a rim 11 of the bottom cover-caseband 1 and is held in place by four screws 12.

The case is closed in a water resistant manner by a flat sapphire crystal 13, the edges 14 of the crystal being bevelled. The rectangular crystal 13 is held in place in a slide surface 15 formed in the extensions 16 of the caseband-bezel 12 situated above the lugs 10 and extending between the latter. The other two sides of the case are covered by crystal 14 which there extend to the edges of the case.

The sealing of the case closure is assured by an annular packing 17 compressed by crystal 13 at the bottom of a groove formed by the internal cylindrical wall 18 of the caseband-bezel 2, the upper surface 19 of the bottom cover-caseband 1 and a flange 20. The compressed packing 17 is likewise effective to prevent an undesired sliding of the crystal 13 in the slide surface 15. For this reason the crystal 13 must be put in place in slide surface 15 before tightening the screws 12 during the closing of the case.

It appears from the preceding description and from the drawing that the only portions of the case risking damage by contact with foreign bodies are the upper surfaces 21 of the extensions 16 which with the caseband-bezel 2 form the slide surfaces 15. In order to preserve the appearance of the case, it is sufficient thus to protect surfaces 21.

As will be seen from the drawing and in accordance with the invention, this protection is assured initially by a substrate 23 directly applied to surface 21, such substrate being obtain from a metallic carbide such as tungsten carbide for instance. The platelet of metallic carbide is fixed to surface 21 by gluing or soldering. In the case of soldering, it is necessary to avoid a temperature exceeding 550° to 600° C. However, other means of fixing may be employed, e.g. studs welded to the lower surface of the platelet as has been described in Swiss Pat. No. 632.886.

Further, according to the invention, the metallic carbide of platelet 23 is covered by a material 22 which here is likewise in the form of a platelet, the hardness of which is greater than 5000 $HV_{0.25}$. Such material may for example be obtained from a polycrystalline diamond or eventually a polycrystalline cubic boron nitride (CBN), the hardness of which is equal to or greater than 8000 $HV_{0.25}$. The assembly formed by substrate 23 and the extra hard material 22 may be commercially obtained from suppliers who manufacture cutting tools, for instance the General Electric Company under the registered trademark "CarboPax". In general the extra hard layer 22 provides a thickness equal to or greater than 0.2 mm. It comprises an applied layer and not a surface treatment.

As has already been said, the material 22 exhibits a hardness greater than 8000 $HV_{0.25}$, this conferring to the watch case scratch resistant properties unknown to the present time. Moreover, this material is today relatively inexpensive since currently employed in industry for machining purposes. It thus avoids the difficulty of preparing a watch case entirely of diamond as mentioned in the introduction to this description.

It will be recalled here that Vickers hardness is defined by the impression remaining following application of a diamond contact of pyramid form onto the material the hardness of which is to be measured. For this purpose one employs a microdurometer where the force and the time of application of the diamond tool are adjustable, then the length of the diagonals of the impression are measured. Since we are concerned with a very hard material, preferably the force with which the tool is applied will be limited to 0.25 kp in order to avoid breaking the tool, this being an explanation of the figure 0.25 as a subscript to the symbol HV employed to designate the Vickers hardness. Under these conditions, the following table gives the Vickers hardness ($HV_{0.25}$) as a function of the length of the measured diagonal in microns ($\mu$m):

| $\mu$m | $HV_{0.25}$ |
|---|---|
| 10 | 4630 |
| 9 | 5700 |
| 8 | 7240 |
| 7 | 9460 |

In setting forth as a lower limit a hardness of 5000 $HV_{0.25}$, one is thus certain to encompass polycrystalline diamond or CBN since the table shows that a hardness of 8000 $HV_{0.25}$ will result in a reading in any case less than 9 $\mu$m.

Figure 2:
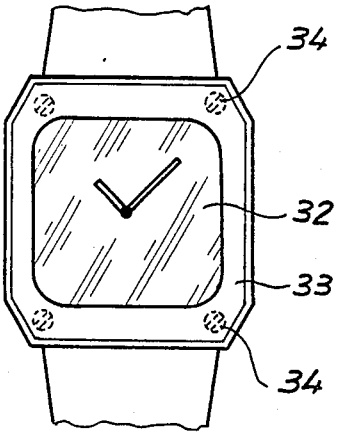
FIG. 2 is a top view of a wrist watch in accordance with a second form of the invention.

In the example shown on FIG. 1, the crystal fixing means which are exposed on the exterior of the watch are in the form of two slide surfaces 15 protected from abrasive agents by two platelets 22 obtained from material the hardness of which exceeds 5000 $HV_{0.25}$. Another form of the invention is shown on FIG. 2 where said fixing means comprise a bezel 33 entirely surrounding crystal 32. This bezel is obtained in the same manner as the platelets mentioned hereinabove, i.e. from a substrate of metallic carbide covered by a material the hardness of which is greater than 5000 $HV_{0.25}$. The fixing of such bezel to a case made in easily machinable material is obtained either by gluing or soldering or eventually by four studs 34 welded against the lower surface of the bezel.

Figure 3:
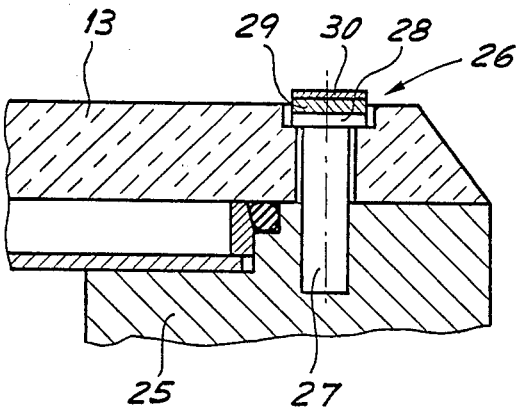
FIG. 3 is a cross section of a part of the watch case according to a third form of the invention.

FIG. 3 is a cross section of a part of the watch case according to a third form of the invention. Here the crystal 13 is fixed to the body of the case 25 by means of studs 26 which traverse the crystal and which are anchored in an appropriate manner in the body 25. The main portion 27 of the stud as well as the lower part 28 of the head thereof is formed of steel for instance. The upper part of the head comprises initially a layer of metallic carbide 29 which serves as a substrate for a material 30 of which the hardness is greater than 5000 $HV_{0.25}$ and which may be polycrystalline diamond. The fixing of the layer 29 to the lower part of the head 28 may be obtained by soldering or by gluing.

Figure 4:
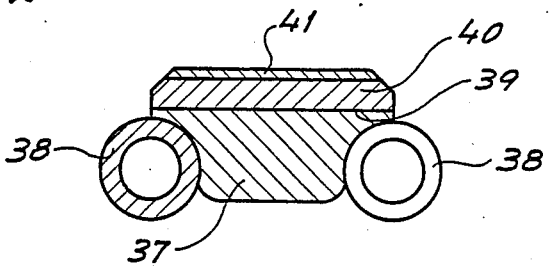
FIG. 4 is a cross section of a bracelet to be applied to the wrist watch according to the invention.

FIG. 4 shows a fourth form of the invention which may be applied to links of a bracelet intended to be applied to the watch. The figure is a cross section through one of the links. The latter includes a body 37 of stainless steel which however could also be in any other machinable material. Hinges 38 assuring articulation of the element shown to the neighbouring elements are fixed to the body 37. To the wearer, it is the upper surface 39 which is exposed to an environment susceptible of scratching. As this is practically the only visible surface of the element shown, it is sufficient to protect this surface by an armour according to the invention in order to render it insensitive to the risk of accidental contacts with foreign bodies. This armour comprises a substrate 40 formed of metallic carbide which is surmounted by a material 41 the hardness of which is greater than 5000 $HV_{0.25}$. As in the preceding examples, it may consist of a polycrystalline diamond or of a polycrystalline boron nitride. The substrate 40 is fixed to body 37 by one of the means mentioned hereinabove.

It should be noted that in the four forms of the invention described hereinabove, the extra hard material (diamond) is always placed on a substrate of metallic carbide. This material is necessary both from the viewpoint of its hardness and its toughness. Effectively, if the substrate was simply of steel or brass, a shock applied to the upper layer of diamond could break the latter by localized staving in of the substrate. In the same manner, if the substrate is hard, it is likewise necessary that it be tough, i.e. that it be little inclined to crack, while at the same time inhibiting propagation of pre-existing cracks. These properties are both present in tungsten carbide (WC).

In the cited example the extra hard material rests on a substrate realized of metallic carbide which in its turn rests on a piece which is to be protected. In certain cases this piece could be likewise formed of a metallic carbide. This might be the case for instance of the bracelet links which would be entirely formed of metallic carbide and on which would be directly applied the extra hard armour of diamond.

Finally, it will be noted that the applied platelets either on the means fixing the crystal to the case or on the links of the bracelet may be bevelled as appears on FIGS. 1 and 4. For such machining known methods may be employed e.g. spark-erosion or again laser machining.

What I claim is:

1. A wrist watch including a case enclosing a movement, a crystal, fixing means exposed at the watch exterior for fixing the crystal to the case and a bracelet, said fixing means being formed partially or totally from a metallic carbide serving as a substrate to a covering material, said covering material having a hardness greater than 5000 $HV_{0.25}$.

2. A wrist watch as set forth in claim 1 wherein said fixing means comprises slide surfaces in which the crystal is engaged.

3. A wrist watch as set forth in claim 1 wherein said fixing means comprises a bezel surrounding the crystal.

4. A wrist watch as set forth in claim 1 wherein said fixing means comprises studs fixing the crystal to the case.

5. A wrist watch as set forth in claim 1 wherein said covering material comprises polycrystalline diamond.

6. A wrist watch as set forth in claim 1 wherein said covering material comprises polycrystalline boron nitride.

7. A wrist watch as set forth in claim 1 wherein the bracelet is formed from links made from a metallic carbide, at least a portion of the visible surfaces of which is covered with a material having a hardness greater than 5000 $HV_{0.25}$.

8. A wrist watch as set forth in claim 1 wherein the bracelet is formed from links the upper surfaces of which are at least partially covered with pads comprising a substrate of metallic carbide, said substrate being coated with a material the hardness of which is greater than 5000 $HV_{0.25}$.

9. A wrist watch as set forth in claim 1 wherein the thickness of said covering material is equal to or greater than 0.2 mm.

* * * * *